United States Patent [19]

Berg

[11] 4,156,418

[45] May 29, 1979

[54] AIR INTAKE SYSTEM FOR ENCLOSED FREESTANDING FIREPLACE

[75] Inventor: Verland V. Berg, 393 Silver City Dr., Boise, Id. 83704

[73] Assignees: Verland V. Berg; Raymond Tracy, both of Boise, Id.

[21] Appl. No.: 846,933

[22] Filed: Oct. 31, 1977

Related U.S. Application Data

[63] Continuation-in-part of Ser. No. 825,969, Aug. 19, 1977.

[51] Int. Cl.[2] ..... F24B 1/18

[52] U.S. Cl. ..... 126/120; 126/143

[58] Field of Search ..... 126/121, 77, 120, 143, 126/146; 110/265; 55/385 R, 323, 327; 123/198 E

[56] References Cited

U.S. PATENT DOCUMENTS

| | | | |
|---|---|---|---|
| 3,359,964 | 12/1967 | Wilson | 126/91 |
| 3,499,432 | 3/1970 | Hannebaum | 126/120 |
| 4,006,733 | 2/1977 | Crownover | 126/143 |
| 4,068,649 | 1/1978 | Johnson | 126/120 |

*Primary Examiner*—Carroll B. Dority, Jr.
*Assistant Examiner*—Henry Bennett
*Attorney, Agent, or Firm*—Paul F. Horton

[57] ABSTRACT

An improved air intake system for a freestanding fireplace of the type having a tubular base secured to a floor support, a firepot mounted on the base, a substantially cylindrical firepot enclosure, and a conical hood having an internally mounted, upwardly spiraling, flange. The improvement includes an air conduit connecting the tubular base to an outside air source located below the floor support and a second conduit extending between the tubular base and the firepot enclosure, the second conduit terminating adjacent one edge of the firepot in a substantially horizontal direction to impart a circular motion to exiting air. Another conduit extending between the tubular base and the firepot enclosure, terminating adjacent an oppositely disposed edge of the firepot from the second conduit and terminating in a substantially horizontal direction opposite to that of the second conduit may be included. The improvement may also include dampers within the conduits extending from the tubular base to the firepot enclosure for controlling air flow; a screen covering the opening of the first conduit to prevent admittance of rodents; and a filter to prevent dusk intake. A doorway into the tubular base for cleaning or replacement of screens and filters may also be included.

6 Claims, 2 Drawing Figures

AIR INTAKE SYSTEM FOR ENCLOSED FREESTANDING FIREPLACE

REFERENCE TO OTHER APPLICATIONS

This invention is a continuation-in-part of my co-pending application Ser. No. 825,969, filed Aug. 19, 1977.

BACKGROUND OF THE INVENTION

1. Field of the Invention

This invention relates, in general, to freestanding fireplaces, and in particular, to air intake systems for freestanding fireplaces having an enclosed combustion chamber.

2. Description of the Prior Art

Primarily because of their structural arrangement and because of their ornamental characteristics, free standing fireplaces have seldom been provided with energy saving devices. The combustion chambers of free standing fireplaces are generally characterized by having large nonclosable openings which result in a noncontrollable draft which draws large amounts of heated air from the room. Heat conduction is largely limited to the smooth interior walls of the hood.

BRIEF SUMMARY OF THE INVENTION

The present invention comprises an improvement to the freestanding fireplace described in my co-pending application; ie., a freestanding fireplace having a base, a firepot mounted on the base, a firepot housing ring encircling the firepot, a substantially cylindrical combustion chamber mounted on the housing, and a conical hood mounted on the combustion chamber. The hood contains a substantially horizontally projecting, upwardly spiraling, flange mounted on the interior wall for imparting a circular motion to the combustion fumes. The improvement includes an air conduit extending between a tubular base and an external air source located below the floor support; an additional pair of conduits extending between the tubular base and the firepot enclosure and terminating at oppositely disposed locations adjacent the firepot in a substantially horizontal direction so as to impart a circular motion to the incoming air; a damper located with these additional air conduits for controlling air flow; a screen and filter; and a door openable into the tubular base for removal and replacement of screens and filters.

It is therefore a general object of the present invention to provide an enclosed free standing fireplace having an external air source.

It is a further object of the present invention to provide a freestanding fireplace having an external air source which includes oppositely disposed air intake vents having their openings in opposite directions for imparting a circular motion to air to facilitate burning.

It is another object of the present invention to provide a freestanding fireplace having an external air source which includes a screen and filter and means in the base portion for removing and replacing the screen and filter.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
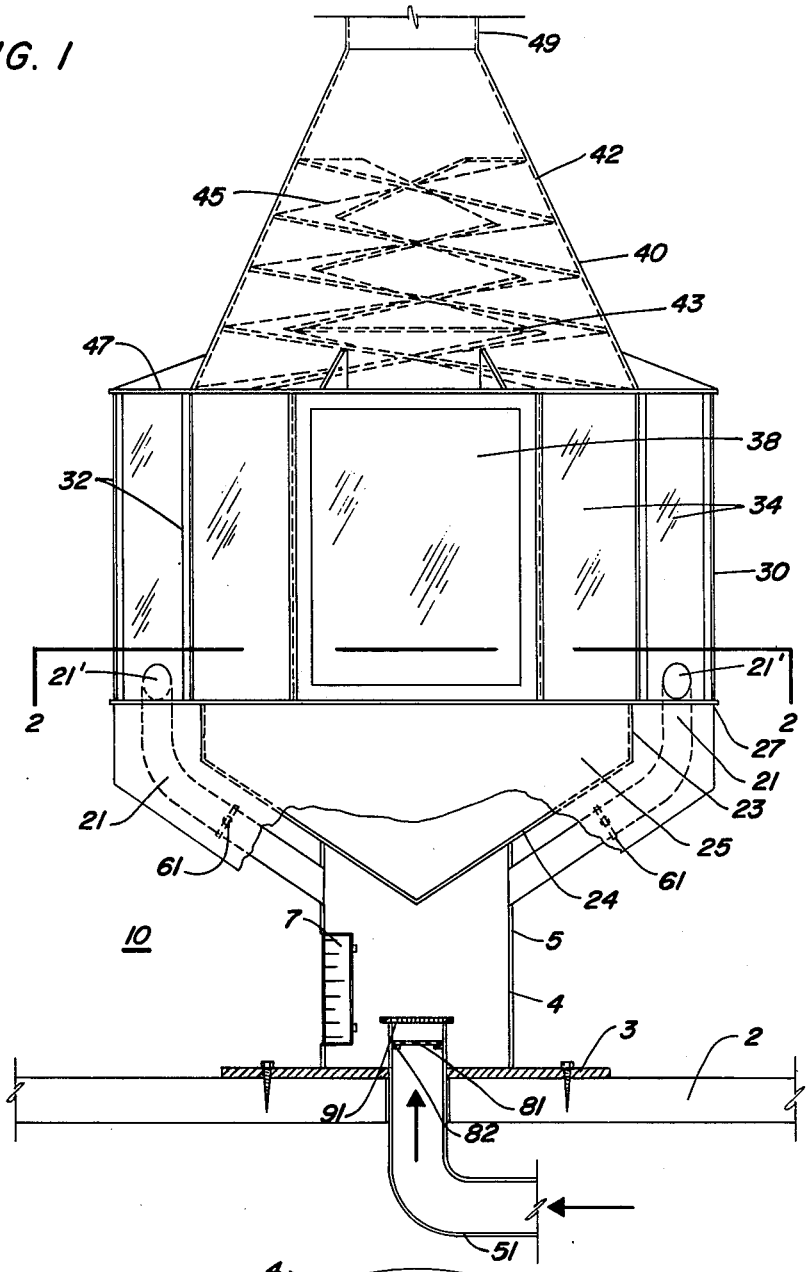
FIG. 1 is a front elevation of a preferred embodiment of the freestanding fireplace of the present invention.
Figure 2:
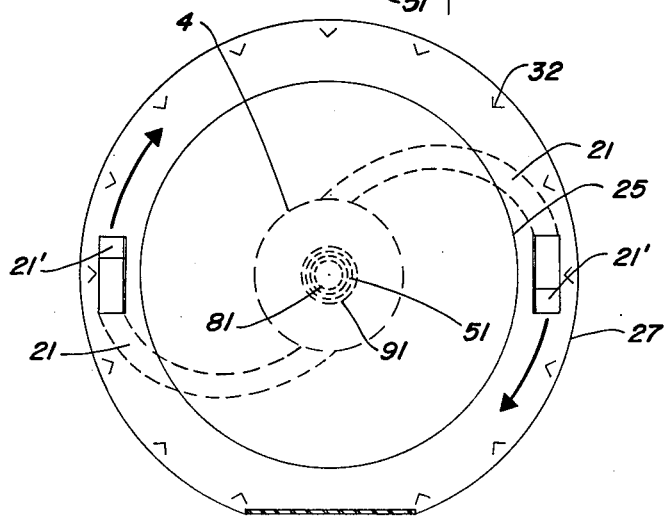
FIG. 2 is a sectional view taken along lines 2—2 of FIG. 1.

Referring now to the drawings, and, more particularly, to FIG. 1, an embodiment to be preferred of a freestanding fireplace 10, made according to the present invention is disclosed. Freestanding fireplace 10 includes a base 5, a firepot housing ring 27, a firepot 25, a combustion chamber 30, and a conical hood 40.

Base 5 is tubular in construction, having a hollow interior and a cylindrical side wall 4. Base 5 may include annular flange 3 welded transversely to wall 4. The flange may be attached to floor 2 by bolts, screws, or the like. Base 5 is formed with a side opening, not shown, and a closure, door 7, which is hingably attached to side wall 4. Base 5 is placed over and surrounds air conduit 51 which vertically extends through an aperture in floor 2. The distal end of air conduit 51 may terminate just below the bottom surface of floor 2, as in mobile homes and other homes having air venting under floor 2, or may terminate by means of a tubular extension through the vertical foundation of a home, it only being essential that conduit 51 terminate to an external air source. Air conduit 51 includes, preferably, at its proximal end which terminates within the interior of base 5, a screen 81 for preventing the entrance of insects, rodents, and the like. Screen 81 is annular in form and may be of any suitably sized mesh. The screen may be placed upon horizontally extending shoulders 82 located on the interior of tube 51 for easy removal and cleaning. Located proximal to screen 81, within conduit 51, is an air filter 91, preferably capping the conduit. Filter 91 prevents the intake of dust and other fine particles into base 5 and therefore into combustion chamber 30. It is to be noted that both the screen and filter are easily removed through the opening in sidewall 4 of base 5.

Firepot 25 is conical in shape having an outer shell structure 24. In place, the cone shaped fire pot has its apex pointed downwardly and centered within base 5. Shell 24 is filled with a fire proof composition containing preferably three parts fire clay, one part sand, and one part cement. The composition is placed in the shell, filling the shell to the top of vertical side walls 23, and is then smoothed out so that it too is conical in configuration. Firepot 25 is securely mounted to base 5 by welding or otherwise. The preferred composition gives the firepot strength and hardness, and keeps the outer part of shell 24 from getting hot, thereby eliminating any fire hazard to close by objects or the floor.

Firepot housing ring 27 is a flat annular ring mounted horizontally flush on the top lip of wall 23 of firepot 25. Ring 27 supports combustion chamber 30 as will hereinafter be described and also contains apertures for air conduits 21. In the preferred embodiment, fireplace 10 includes two air conduits, at one end connected to and opening into the interior of base 5 and at the other end opening into combustion chamber 30 through ring 27 at an angle preferably less than 45° to horizontal. The points of entrance through ring 27 of the two conduits 21 are oppositely disposed adjacent firepot 25 and have their openings facing in directions opposite to one another so as to provide a circular motion to air entering the combustion chamber through the conduits. In this regard, conduits 21 may approach ring 27 at a substantially horizontal angle or baffles 21' may be used to accomplish the result. Baffles 21' may simply be an extension of conduits 21. Conduits 21 may each contain a conventional butterfly damper 61 for controlling air flow to the combustion chamber.

Combustion chamber 30 may be substantially cylindrical in configuration. The chamber is octagonal in the preferred embodiment containing a plurality of metallic vertical supports 32, each of which ecases and holds in place tempered glass panels 34. The entire structure is securely mounted vertically on ring 27. Chamber 30 also includes a tempered glass door 38 which sealingly closes the combustion chamber when closed, and when open, provides entrance to the firepot for the placement of combustible materials and for the removal of ashes.

A second flat horizontal ring 47 is mounted horizontally on and secured to the top most terminal ends of vertical supports 32. Upper ring 47 serves to hold vertical supports 32 in place and also serves as a base support for hood 40. Hood 40, of conventional conical formation, is provided with a flue vent 49 which is centrally mounted adjacent the apex of the cone-shaped hood. Mounted on the interior wall 42 of hood 40 is a horizontally oriented, upwardly spiraling flange 45 extending from substantially the lowermost portion of the hood to the uppermost portion of the hood adjacent flue vent 49. Flange 45 may spiral upward in either a clockwise or counter clockwise direction, it only being necessary that it spiral upward in the same direction as the openings of conduits 21. An annular damper plate 43 may be installed, preferably adjacent the base of conical hood 40 between opposing portions of the flange.

In operation, combustible material is either piped into the firepot 25 or placed in firepot 25 through door 38, and ignited. Damper controls 61 are set at a selected setting to allow a desired amount of air flow into the combustion chamber 30 in communication with firepot 25. As the air is heated within combustion chamber 30, air will be pulled through the distal end of air conduit 51, through screen 81 and filter 91, into base 5 and through conduits 21 into combustion chamber 30. With air conduits 21 opening into the combustion chamber at opposite angles, it will be seen that a circular draft is created. The air and fumes of combustion moving in a circular motion are pulled upwardly into hood 40 by the draft. Damper plate 43 prevents a purely vertical motion to the air, forcing the air to continue in its upward spiral along the bottom most edges of flange 45. In this manner the upward draft is slowed allowing the extending flange 45 to absorb a large portion of the heat from the heated air and fumes. Flange 45, being metallic and in direct conductive union with hood wall 42, also metallic, allows a large percentage of the heat thus absorbed to be radiated from the exterior wall 42 of hood 40 into the surrounding air. The smoke and fumes then pass through air vent 49 which is connected to a chimney or other venting device.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. An improved freestanding fireplace of the type having a tubular base secured to a floor support, a fire pot mounted on the base, a substantially cylindrical firepot enclosure and a conical hood having an internally mounted upwardly spiraling flange, wherein the improvement comprises:

a first conduit extending between and in fluid communication with the tubular base and an external air source; and a second conduit extending between and in fluid communication with the tubular base and the firepot enclosure, said second conduit terminating proximally in the firepot enclosure in a substantially horizontal direction, parallel to the enclosure for imparting a circular motion to air convected through said second conduit.

2. An improved freestanding fireplace as described in claim 1 further comprising:

a third conduit extending between and in fluid communication with the tubular base and the firepot enclosure, said third conduit terminating proximally in the firepot enclosure at a location oppositely disposed to said second conduit, and in a substantially horizontal direction opposite said second conduit, parallel to the enclosure for imparting a circular motion to air convected through said third conduit.

3. An improved freestanding fireplace as described in claim 2 further comprising:

dampers located within said second and third conduits for controlling air flow to the firepot enclosure.

4. An improved freestanding fireplace as described in claim 1 further comprising a screen covering the opening of said first conduit.

5. An improved freestanding fireplace as described in claim 1 further comprising filter means covering the opening of said first conduit.

6. An improved freestanding fireplace as described in claim 1 wherein said tubular base includes opening and closing means for installing and removing screens and filters.

* * * * *